US008328987B2

(12) United States Patent
Beaupre et al.

(10) Patent No.: US 8,328,987 B2
(45) Date of Patent: Dec. 11, 2012

(54) PROCESS OF MAKING A WET FORMED CELLULOSIC PRODUCT AND A WET FORMED CELLULOSIC PRODUCT

(75) Inventors: James J. Beaupre, St. David, ME (US); David J. Neivandt, Bangor, ME (US); Kenneth P. Kehrer, Lancaster, PA (US)

(73) Assignee: Armstrong World Industries, Inc., Lancaster, PA (US)

( * ) Notice: Subject to any disclaimer, the term of this patent is extended or adjusted under 35 U.S.C. 154(b) by 36 days.

(21) Appl. No.: 12/874,010

(22) Filed: Sep. 1, 2010

(65) Prior Publication Data

US 2011/0048659 A1 Mar. 3, 2011

Related U.S. Application Data

(60) Provisional application No. 61/275,743, filed on Sep. 1, 2009.

(51) Int. Cl.
*D21H 11/00* (2006.01)

(52) U.S. Cl. ..... 162/164.5

(58) Field of Classification Search ..... 162/164.5, 162/158, 164.1, 164, 168.1, 168, 175, 176, 162/178, 181.6, 181.8, 72, 77
See application file for complete search history.

(56) References Cited

U.S. PATENT DOCUMENTS

| | | | | |
|---|---|---|---|---|
| 4,062,721 | A | 12/1977 | Guyer et al. | |
| 6,706,144 | B1 * | 3/2004 | Furman et al. | 162/72 |
| 2007/0169904 | A1 | 7/2007 | Nguyen | |

FOREIGN PATENT DOCUMENTS

| | | | |
|---|---|---|---|
| EP | 0495430 | A1 | 1/1992 |
| EP | 1113107 | A2 | 7/2001 |
| EP | 1375736 | A1 | 1/2004 |
| EP | 2093278 | A1 | 8/2009 |
| WO | 0063487 | A1 | 10/2000 |
| WO | 03106766 | A1 | 12/2003 |

OTHER PUBLICATIONS

Allan Springer, Lola Ann Nabors, and Om Bhatia, "The influence of fiber, sheet structural properties, and chemical additives on wet pressing", Tappi Journal, Apr. 1991, pp. 221-228.

Sunkyu Park, Richard A. Venditti, Hasan Jameel, and Joel J. Pawlak, "Hard-to-remove water in cellulose fibers characterized by thermal analysis: A model for the drying of wood-based fibers", Tappi Journal, Jul. 2007, pp. 10-16.

Theodore H. Wegner, "The effects of polymeric additive on papermaking", Tappi Journal, Jul. 1987, pp. 107-111.

Robert A. Stratton, "Use of Polymers in Wet Pressing", Tappi Proceedings, 1982, pp. 179-185.

L.H. Busker and D.C. Cronin, "The relative importance of wet press variables in water removal", Pulp and Paper, Canada, Jun. 1984, pp. T138-T147.

"Water retention value (WRV) UM 256", 1991 Issue of Tappi Useful Methods, 1991, pp. 54-56.

International Search Report/Written Opinion of the International Searching Authority for PCT/US2010/047560, mailing date Nov. 18, 2010.

* cited by examiner

*Primary Examiner* — Mark Halpern
(74) *Attorney, Agent, or Firm* — McNees Wallace & Nurick LLC

(57) ABSTRACT

According to the disclosure, a process of making a wet formed cellulosic product and a wet formed cellulosic product are disclosed. The process includes providing a slurry, forming the slurry into a cellulosic product, dewatering the cellulosic product, drying the cellulosic product, and applying an additive to one or more of the slurry and the cellulosic product. The additive modifies one or more of bulk, charge, potential, cumulative pore volume, surface tension of the cellulosic product.

5 Claims, 9 Drawing Sheets

PROCESS OF MAKING A WET FORMED CELLULOSIC PRODUCT AND A WET FORMED CELLULOSIC PRODUCT

PRIORITY

This application claims priority to and benefit of U.S. Provisional Patent Application No. 61/275,743, filed Sep. 1, 2009, and titled "Enhancement of Water Removal in Pressing and/or Drying Portions by the Addition of a Cationic Surfactant," which is hereby incorporated by reference in its entirety.

FIELD OF THE INVENTION

The present invention is directed to cellulosic product forming processes and cellulosic products. More specifically, the present invention is directed to a process of applying an additive to a cellulosic products including a surfactant.

BACKGROUND OF THE INVENTION

The manufacture of a cellulosic product such as a sheet of paper from a pulp slurry includes forming portions, pressing portions, and drying portions. Forming the cellulosic product (for example, the sheet of paper) can involve the removal of water by forming section drainage, pressing, and drying. There has been much work conducted in exploring mechanical processes of enhancing removal of water prior to the drying in order to reduce the amount of energy needed for the drying process. As such, there is a need for improvements in the forming section drainage and pressing section drainage that do not require substantial capital investment.

As paper machines age and speed requirements increase, the machines tend to become limited by the drying portions and/or pressing portions. This limits the rate at which water can be removed. Speed above a predetermined rate produces a sheet with higher than desirable moisture levels.

Dewatering advancements in the forming portions and pressing portions have generally been mechanical. A higher dryness coming from the forming portions into the pressing portions may lead to a higher dryness exiting the pressing portions and leads to a lower water load entering the drying portions, thus allowing for a savings in energy or an increase in production.

Pressing portions can be the last chance to increase the dryness of the sheet before entering the drying portions. In pressure controlled pressing portions, the resistance to flow between the fibers of the sheet is insignificant. The dryness of the sheet is dictated by the flow of water exiting the fiber wall. Water in the controlled pressing portions involves a flow phenomenon with the press impulse being the major driving force. Water is removed proportional to the water load of the sheet at a maximum operational pressure. A greater dryness can be achieved by increasing the pressure applied to the sheet, however, above the maximum operational pressure, the structural integrity of the sheet is overcome and the sheet is crushed, creating a lower quality product. Pressure controlled pressing portions apply to single felted presses with basis weights up to 100 g/m$^2$ and to double felted presses with basis weights up to 150 g/m$^2$. The pressure controlled pressing portions can be extended to heavier sheets at higher speeds with modern shoe presses.

Conversely, flow controlled pressing portions are defined by conditions where the rate of water removal is constant at a given set of pressing parameters. This is a sign of poor operational pressing conditions. In the flow controlled pressing portions, water removal follows Darcy's law, as dryness is a function of the press impulse with no independent effect of pressure or time. This condition arises when the water which is being pressed from the sheet is removed at a slower rate than it is created, defeating the purpose of applying a greater pressure. To overcome the limitation, the rate at which water is carried away from the pressing zone is increased in order to achieve a greater dryness out of the press and to revert to the pressure controlled regime.

In Stratton R. A., *Use of polymers in wet pressing*, Tappi Proceedings Papermakers Conference, pp. 179-185 (1982), hereinafter "Stratton," which is incorporated by reference in its entirety, various cationic wet end polymers were utilized to demonstrate that increases of up to about 1% to 2% solids out of a press section are possible by addition of the polymers to the wet end. Stratton focused solely on the use of the polymers in wet pressing. Increasing the concentration of the polymers resulted in increased solids.

Busker L. H., Cronin D. C., *The relative importance of wet press variables in water removal*, Pulp and Pap Can, 85:87-101 (1984), which is incorporated by reference in its entirety, suggested that additives are not apt to be the most productive areas of research and development for large gains in water removal.

In Wegner T H, *The effect of polymeric additive on papermaking*, Tappi J 7:107-111 (1987), hereinafter "Wegner," which is incorporated by reference in its entirety, the effects of cationic polyacrylamide on water removal in the forming, pressing, and drying sections were discussed. Wegner observed that while an increase in drainage was evident, the sheet behavior during wet-press dewatering was unaffected. It was noted, however, that wet pressing with a cationic polyacrylamide could compensate for higher moisture levels entering the press while maintaining the solids content exiting the press.

In Springer A, Nabors L A, Bhatia O, *The influence of fiber, sheet structural properties, and chemical additives on wet pressing*, Tappi J, 4(2):221-228 (1991), hereinafter "Springer," which is incorporated by reference in its entirety, chemical additives such as cationic polyacrylamides were shown to have an indirect influence on wet pressing. These chemical additives increased solids exiting the forming section. However, the gains associated with the increased solids were lost during the pressing section. Springer indicated that for sheets entering the press at equal moistures, the additives had no effect on the outgoing solids content. Springer postulated that if an additive was to have any effect on press enhancement, the additive must be able to penetrate the fiber structure and influence its water holding capacity.

What is needed is a process of forming cellulosic products and cellulosic products, capable of dewatering while not suffering from the above-drawbacks.

SUMMARY OF THE INVENTION

In an exemplary embodiment, a process of making a wet formed cellulosic product including providing a slurry, forming the slurry into a cellulosic product, dewatering the cellulosic product, drying the cellulosic product, and applying an additive to one or more of the slurry and the cellulosic product. A surfactant is in one or more of the slurry and the cellulosic product.

In another exemplary embodiment, a process of making a wet formed cellulosic product includes providing a slurry having a surfactant and an additive, forming the slurry into a cellulosic product, dewatering the cellulosic product, drying the cellulosic product, and complexing the additive with the surfactant. The surfactant further dewaters the cellulosic product and the complexing of the additive with the surfactant modifies one or more of bulk of the cellulosic product, charge of the cellulosic product, potential of the cellulosic product, cumulative pore volume of the cellulosic product, and surface tension of the cellulosic product.

In another exemplary embodiment, a wet formed cellulosic product includes a surfactant and an additive, wherein the additive includes one or more of bentonite; polyacrylamide; montmorrilnites; phylosilicates, anionic additives; polyacrylic acid; polystyrene sulfonate; polyerms having an acid selected from the group consisting of sulfonic acid, phosphoric acid, salts of carboxylic acid, salts of phosphoric acid, salts of sulfonic acid, and salts of phosphoric acid; natural polymers; modified natural polymers; synthetic polymers; homopolymers of polyacrylates; homopolymers of polysulfonates; homopolymers of polyphosphates; copolymers of polyacrylates; copolymers of polysulfonates; copolymers of polyphosphates. polyacrylic acid, polymethacrylic acid, polystyrenesulfonic acid, carboxymethylcellulose, guar and xanthan gums; anionic starch; amphoteric starch, copolymers of acrylic acid and acrylamide; silica calcium carbonate; titanium dioxide; and alumina.

An advantage of an embodiment of the present invention includes the ability to reduce energy consumption in wet form processes due to the non-mechanical dewatering.

Another advantage of an embodiment of the present invention includes the ability to increase an overall amount of dewatering due to a combination of mechanical and non-mechanical dewatering.

Another advantage is the ability to manipulate bulk of the cellulosic product formed.

Another advantage is the ability to manipulate charge and/or potential of the cellulosic product formed.

Another advantage is the ability to manipulate in surface tension of the cellulosic product formed.

Another advantage is the ability to manipulate cumulative pore volume of the cellulosic product formed.

Other advantages will be apparent from the following description of exemplary embodiments of the disclosure.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Provided is a process of making a wet formed cellulosic product that includes providing a slurry, forming the slurry into a cellulosic product, pressing the cellulosic product to dewater the cellulosic product, drying the cellulosic product, and applying an additive to one or more of the slurry and the cellulosic product. In one embodiment, a surfactant is in one or more of the slurry and the cellulosic product. In another embodiment, the surfactant further dewaters the cellulosic product, and complexes the additive with the surfactant thereby preventing/controlling/manipulating one or more of bulk of the cellulosic product, charge and/or potential of the cellulosic product, cumulative pore volume of the cellulosic product, and surface tension of the cellulosic product.

Exemplary additives include, but are not limited to bentonite; polyacrylamide; the related categories and classifications of bentonite and/or polyacrylamide; anionic additives; polyacrylic acid; polystyrene sulfonate; a polyerm having an acid selected from the group consisting of sulfonic acid, phosphoric acid. salts of carboxylic acid, salts of phosphoric acid, salts of sulfonic acid, and salts of phosphoric acid. Additionally or alternatively, the additive can be selected from the group consisting of natural polymers, modified natural polymers, synthetic polymers, homopolymers of polyacrylates, homopolymers of polysulfonates, homopolymers of polyphosphates, copolymers of polyacrylates, copolymers of polysulfonates, and copolymers of polyphosphates. Additionally or alternatively, the additive can be selected from the group consisting of polyacrylic acid, polymethacrylic acid, polystyrenesulfonic acid, carboxymethylcellulose, guar and xanthan gums, anionic and amphoteric starch, copolymers of acrylic acid and acrylamide, silica calcium carbonate; titanium dioxide; and alumina. In one embodiment, the additives is any suitable additive capable of complexing the surfactant. In other embodiments, the effects of the surfactant(s) and/or additive(s) can be manipulated to achieve desired properties within any suitable predetermined range. For example, the surfactant(s) and/or additive(s) can permit a predetermined bulk to be achieved. The predetermined range can be based upon any suitable quantifiable analysis.

Figure 1:
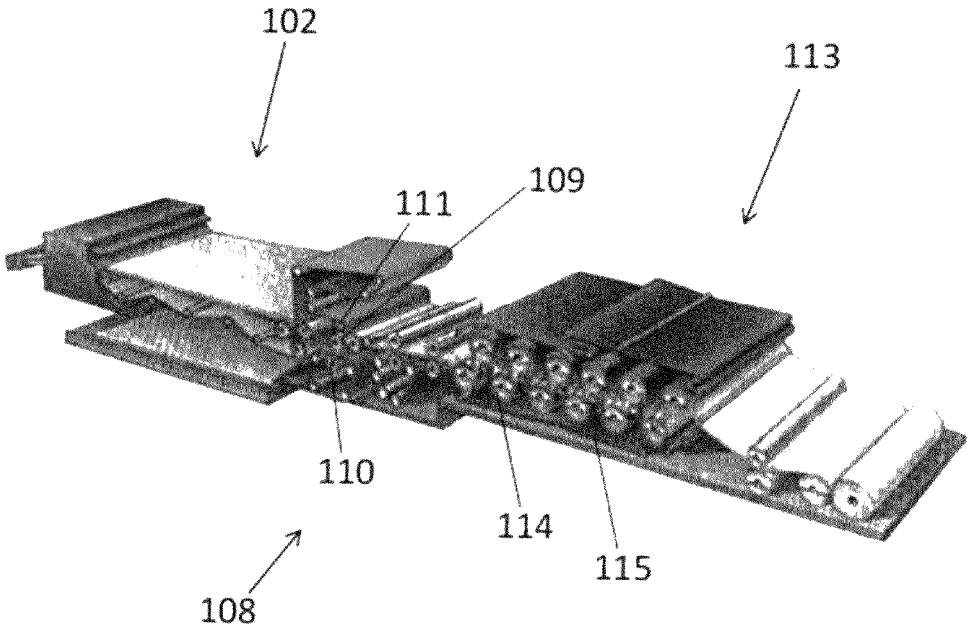
FIG. 1 shows an exemplary paper forming system according to the disclosure.

As will be appreciated, the cellulosic products can be paper, ceiling board, paneling, fiberboard, cardboard, cellulosic composites, MDF, HDF, decking, flooring, or any other suitable wet formed cellulosic product. Referring to FIG. 1, in one embodiment, the cellulosic product is paper produced by a paper forming system 100. In this embodiment, the slurry is a pulp slurry formed into the paper by forming portion 102. It will be appreciated that the pulp slurry can be formed by any suitable pulping process, any suitable disintegrating process, any suitable pulverizing process, and/or other suitable processes for forming cellulosic components of a slurry. As used herein, the terms "pulp," "pulping," and grammatical variations refer to any of these processes or any combination of these processes. The forming portion 102 dewaters the paper by drainage of water through a fiber mat. The water is removed by gravity through free drainage and subsequently by generating a pressure gradient across the fiber mat. This pressure gradient is created by placing stationary hydrodynamic foils underneath a forming fabric. The forming fabric provides initial stability of the newly formed sheet. The speed of the sheet over the hydrodynamic foils results in a pressure drop behind the hydrodynamic foils due to Bernoulli's principle. As the sheet progresses through the forming portion 102, the hydrodynamic foils are assisted by the addition of vacuum boxes to further dewater the sheet. At the end of the forming section, the sheet enters the pressing portion at about 20% solids depending upon the basis weight of the sheet (heavier sheets are wetter).

Upon exiting the forming portion 102, the sheet enters the pressing portion 108. The pressing portion 108 can include any suitable pressing mechanisms. In one embodiment, the pressing portion 108 removes water from the sheet and compresses the sheet so that fiber-fiber hydrogen bonding can begin to occur. The pressing portion 108 continues the dewatering that began in the forming portion 102. A press nip 109, where the dewatering of the sheet occurs due to a pressure pulse, is located between a first press roll 110 and a second press roll 111. Of these two rolls 110, 111, one is covered with rubber and the second is either a steel or composite covered roll. The sheet is transferred from the forming fabric in the forming portion 102 to felts in the pressing portion 108. The forming fabric and the felts provide support for the sheet which cannot yet support its own weight and assist in carrying excess water from the sheet. The sheet leaves the pressing portion 108 at about 40% to about 50% solids.

After the pressing portion 108, the sheet enters the drying portion 113. The drying portion 113 can include any suitable drying mechanisms. The drying portion 113 can be the most expensive portion of the process to install in terms of the capital cost of equipment and installation. Further, the drying portion 113 can have the greatest operational cost due to high energy consumption for evaporating remaining water from the sheet. In one embodiment, the sheet enters the drying portion 113 at about 50% to about 60% moisture and passes over steam heated rolls 114 to apply energy for drying. Additionally or alternatively, drying can occur by steam heat in dryer cans, infrared dryers, natural gas dryers, other suitable dryers, or any suitable combination. In one embodiment, dryer felts in a two tier steam dryer are used to initially aid in supporting the sheet and, later, in the drying portion 113 to hold the sheet tightly to the steam heated rolls 114 to increase heat transfer. The moisture content of the final product is about 5%.

The pulp slurry used in the paper forming system 100 can be any suitable pulp slurry. In one embodiment, the pulp slurry includes wood fibers composed of wood cells that include cellulose, lignin, and hemicelluloses. Generally, the wood cells are assemblies of cellulose chains forming a framework that is encompassed by a hemicellulose matrix, and the lignin serves as an adhesive. Cellulose fibrils, which are smaller cellulose frameworks that combine to create cell walls, adhere to each other through hydrogen bonding. These fibrils assemble to create wood cells having several cell wall layers. The cell walls include a primary wall and three layers of secondary walls. The cell wall surrounds a hollow center, the lumen. The individual cells are held together by the lignin as well as by the middle lamella. The middle lamella is a conglomeration of hemicelluloses and lignin located between cells. The primary wall encompasses the secondary walls and separates it from the middle lamella. The secondary layer makes up the majority of the cell wall. To enter the lumen, molecules travel by diffusion through the cell wall or through larger holes that connect the outside of the cell to the interior (pits). Pits allow for the transport of water in the radial direction of the tree structure by connecting adjacent cells to each other through the middle lamellae. Once the cell is pulped, the pits allow for the impregnation of the fiber with various additives used in the process of forming paper. In most pulping processes, the middle lamella is destroyed and carried out by the pulping liquors from the resulting wood pulp.

The wood fiber includes cellulose at about 50% to about 70% of the fiber content and lignin of about 25% to about 45% of the fiber, with the remaining portion of the fiber being made up of hemicelluloses and other wood polysaccharides. The majority of the lignin is found within the cell wall, with the surface of the fiber primarily including cellulose. The cellulose includes polymerized β-D-glucopyranoses in the $^4C_1$ chair confirmation joined by a β1-4 glycosidic linkage. The linked chains are bound together through hydrogen bonding creating microfibrils which in turn form the walls of the cellulose fibers. The abundance of hydroxyl groups creates many locations for hydrogen bonding. Hydrogen bonding facilitates interfiber bonding and enhances the formation of cellulosic products such as paper, providing their core strength. This versatile chemical framework also permits application of surface treatments in industrial production to adjust brightness and strength.

The slurry includes wood pulp formed by reducing raw wood to a slurry of wood fibers. This is accomplished by methodically destroying the bonds that hold the wood together, which may be achieved by chemical processes, mechanical processes, or a combination of the two. This forms carboxylic acid groups on the cellulose chains resulting in a negative surface charge. Different methods of pulping produce different quality pulps that contain varying proportions of the three wood cell components. In one embodiment, the pulp is formed by chemical pulping (for example, by the kraft process) and has corresponding concentration of cellulose, lignin, and hemicelluloses. Chemical pulping dissolves the middle lamella that holds the wood cells together. This dissolves the bonds holding the cells together and reacts away portions of the cellulose fiber, leading to lower pulp yields. The majority of lignin left in the chemical pulping processes is found within the cell walls. This residual lignin does not affect the ability of the fiber surface to hydrogen bond with adjacent fibers. A greater number of hydrogen bonds between adjacent fibers leads to a stronger final product. In another embodiment, the pulp is formed by mechanical pulping and has a corresponding concentration of cellulose, lignin, and hemicelluloses. In this embodiment, the pulp has a higher lignin content than chemical pulps due to the fact that mechanical pulping physically ruptures bonds between wood cells to create a fibrous mass.

In one embodiment, the pulp slurry is about 0.5% cellulose fibers and filler and about 99.5% water when it begins the sheet formation process. The water in the pulp slurry exists in the vicinity of the cellulose fibers as unbound water, freezing-bound water, and nonfreezing-bound water. The unbound water is water that is capable of being removed in the dewatering of the forming portions and/or pressing portions (further described below). The unbound water has a freezing temperature consistent with bulk water (about 0° C.). The bound water, both freezing and nonfreezing, neighbor the fiber surface. As used herein, the phrase "nonfreezing-bound water" refers to the few layers of water adjacent to the fiber surface that due to the strong interfacial interaction are unable to undergo conformational rearrangements necessary to freeze. Stated another way, nonfreezing-bound water molecules have no freezing temperature. As used herein, the phrase "freezing-bound water" refers to water which is bound to the nonfreezing-bound water and is adjacent to the bulk fluid. Freezing-bound water has a depressed freezing point due to its proximity to the nonfreezing-bound water. These types of water have been compartmentalized by differential scanning calorimetery and thermogravimetric analysis into two categories, easy-to-remove water and hard-to-remove water. As used herein, the phrase "easy-to-remove water" refers to free water and contains nearly all of the available unbound water (about 75% of the unbound water). As used herein, the phrase "hard-to-remove water" refers to trapped unbound water within the fiber walls (about 25% of the total unbound water) as well as all of the freezing and nonfreezing-bound waters. Hard-to-remove water accounts for about 30% to about 60% of the total water remaining in the sheet after pressing.

According to the disclosure, the pulp slurry is configured to provide additional dewatering during the forming portions and/or pressing portions through a non-mechanical mechanism. For example, in one embodiment, the pulp slurry includes a surface active agent or surfactant. In a further embodiment, the surfactant is a cationic surfactant. For example, the cationic surfactant can be cetyl trimethylammonium bromide ($(C_{16}H_{33})N(CH_3)_3Br$) depicted below:

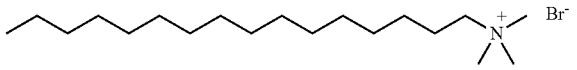

The pulping process generates several types of bonding sites on the wood fiber which can be used for surface modification. In addition to the native hydroxyl sites for hydrogen bonding, there are many carboxylic acid groups which form on the surface of the fibers during pulping. These groups can disassociate forming sites for electrostatic interactions. These electrostatic sites may be targeted for surface modifications, specifically by the surfactant. Additionally, interaction between the hydrophobic tail of the surfactant adsorbs to the cellulosic product.

Surfactants are organic compounds that are amphiphilic (i.e. they contain both hydrophobic groups, known as tails, and hydrophilic groups, known as heads). Due to their amphiphilic nature, surfactants are typically soluble in both organic solvents and water. The type of head group classifies surfactants as either anionic, cationic, non-ionic, or zwitterionic (amphoteric), each of which may be used alone or in combination according to embodiments of the present disclosure. The amphiphilic nature of the surfactant leads to a driving force for the surfactant to migrate and adsorb or self-assemble at interfaces (e.g. air/liquid, liquid/liquid, and solid/liquid). At the liquid-gas interface (e.g. water-air), the surfactant acts to reduce the surface tension. Similarly, the surfactant can reduce the interfacial tension between two liquids by adsorbing at the liquid-liquid interface. Liquid-solid interfaces may also be modified by adsorption of the surfactant, leading, for example, to changes in surface energy, interfacial morphology, and the contact angle of liquids on the modified surface. Above a predetermined concentration, the surfactant assembles in bulk solution forming aggregates known as micelles. When micelles assemble in water, the hydrophobic tails of the surfactant create an inner core and the hydrophilic head groups form an outer shell that maintains favorable contact with water reducing the free energy.

In one embodiment, the surfactant modifies the surface of the cellulose fibers through the process of self-assembly. The adsorption of the surfactant on a cellulose surface is classified as self-assembly. Electrostatic forces and the hydrophilic nature of the surfactant and the cellulose fiber provide non-covalent contributions to the bonding. The alkyl chain of the surfactant contributes additional driving forces for adsorption.

As discussed above, the surface of the wood fiber includes cellulose and carboxylic acid groups formed by pulping. The carboxylic acid groups provide electrostatic bonding sites. This allows for adsorption of various hydrophilic head groups of the surfactant. Adsorbing a cationic surfactant onto the cellulose surface creates an increase in the zeta potential of the cellulose. The zeta potential is an electric potential in the interfacial double layer at the slipping plane versus a point in the bulk fluid away from the colloidal interface. That is, zeta potential is the potential difference between the dispersion medium and the stationary layer of fluid attached to the surface. The dispersion medium in the pulp slurry is the water surrounding the cellulose fibers and the stationary layer of fluid is bound water on the fiber. The change in surface energy associated with the cellulose fiber changes the behavior of cellulose surface interactions (e.g. fiber-fiber, fiber-water, etc.).

The surfactant can have any suitable chain length. Chain lengths can be C12, C14, C16, C18, or any other suitable chain length. Adsorption isotherms of cationic surfactants with varying alkyl chain lengths on cellulose surfaces show the dependence of adsorption on the chain length. Increasing surfactant chain length leads to a shift of adsorption toward lower concentrations and to a continuous increase in the maximum adsorbed amount of surfactant. This trend is attributed to the entropic driving forces derived from the hydrophobic surfactant tails.

In one embodiment, the wood pulp is chemically modified to enhance pulp qualities due to the reuse and recycling of paper in the wood pulp. While some properties of a recycled pulp can be improved by chemical treatments, other aspects of the pulp are negatively affected. Recycled pulp treated with butylamine and ammonia results in lower hydroxyl contents. The water holding capacity decreases after the treatment; however, the pulps also decrease in tensile strength. The reduction in the number of hydrogen bonding sites (hydroxyl groups) is believed to decrease fiber-fiber bonding strength, as evidenced by the lower tensile strength, and to lead to the decrease in water holding capacity due to a reduction in hydrophilicity of the fiber surfaces.

In one embodiment, the pulp slurry reduces the hydraulic force for exceeding capillary force holding water within the fiber within the lumen and between fibers through the reduction of the capillary force itself. Parameters governing the water removal from capillaries within the fiber within the lumen and between the fibers are given by the Young-Laplace equation and are the water-air surface tension, the cellulose-water contact angle, and the pore radius.

$$\Delta P = \frac{2 \cdot \gamma_{lg} \cdot \cos(\theta_{ls})}{r} \quad (1)$$

Where ΔP is the pressure difference across the liquid-gas (water-air) interface, $\gamma_{lg}$ is the liquid-gas (water-air) surface tension, $\theta_{ls}$ is the solid-liquid (fiber-water) contact angle, and r is the capillary radius. Surfactants adsorb on cellulose (cationic surfactants in particular) and hence affect the surface energy and potential and consequent contact angle. Additionally, surfactants modify the water-air surface tension and/or changes in pore radii. The quantity of the surfactant can be manipulated to achieve any of the properties disclosed herein within any suitable predetermined range including, but not limited to, those disclosed in the Examples below.

In one embodiment, surfactants are added in the pulping process of recycled fiber (printed and/or unprinted), virgin fiber, or a combination thereof. The recycled fiber exhibits a larger water holding capacity than the virgin fiber due to its level of fiber destruction through repeated processing. In one embodiment, the virgin fiber is 85% softwood and 15% hardwood kraft mix commonly used in paper making.

Addition of the surfactant can affect qualities of the cellulosic product. These qualities can include bulk, charge and/or potential, surface tension, and/or cumulative volume of pores in the cellulosic product. To counter-act such effects, in one embodiment, an additive is applied to the slurry and/or the cellulosic product. In another embodiment, the additive is complexed with the cellulosic product and/or the surfactant.

The additive can be any suitable additive capable of counter-acting predetermined qualities. For example, the additive can be selected to counter-act the surfactant. For instance, the additive can decrease or prevent an increase in bulk of the cellulosic product, decrease or prevent an increase in cumulative pore volume of the cellulosic product (which is related to bulk), decrease or prevent an increase in charge and/or potential of the cellulosic product, increase or prevent a decrease in surface tension of the cellulosic product, or any combination thereof. It will be appreciated that the use of the term "prevent" hereinafter includes a reduction, an elimination, or a decrease in a rate. For example, although cumulative pore volume may increase, the additive can prevent an increase in cumulative pore volume by decreasing a rate of an increase in cumulative pore volume.

Generally, the additive is added to the slurry after the surfactant. In one embodiment, the additive is bentonite. Bentonite is an absorbent aluminum phyllosilicate. Bentonite can include impure clay including montmorillonite. The bentonite can consist essentially of potassium (K), sodium (Na), calcium (Ca), and aluminum (Al) such that the properties of one of these specific element dominates the properties of the bentonite. For example, in one embodiment, the bentonite is sodium bentonite. In another embodiment, the bentonite is calcium bentonite. In another embodiment, the bentonite is postassium bentonite. The bentonite can be in solution, dry, or in a colloidal suspension. The bentonite decreases bulk, decreases charge and potential, increases surface tension, and decreases cumulative pore volume of the cellulosic product. The bentonite increases WRV.

In one embodiment, the additive is anionic polyarcrylamide. Polyarcrylamide decreases bulk, decreases potential, does not notably affect charge, and decreases cumulative pore volume (although the decrease is negligible for thin substrates). The polyarcrylamide does not significantly affect WRV. The polyarcrylamide decreases surface tension.

The quantity of the additive can be adjusted in comparison to the quantity of the surfactant. In one embodiment, the amount of bentonite and/or polyacrylamide in comparison to the surfactant is adjusted to achieve desired qualities for the cellulosic product by using the least amount of the additive necessary. For example, such relationships can be extrapolated or interpolated based upon data shown in Examples 13 through 16.

In one embodiment, the additive includes a combination of bentonite and polyacrylamide. In a further embodiment, the quantity of bentonite in relation to polyacrylamide is balanced to achieve predetermined qualities. For example, based upon determinations by an operator monitoring the process (or other suitable analytical techniques), the amount of bentonite in comparison to polyacrylamide may be increased to increase the surface tension of the cellulosic product being formed. Alternatively, the amount of polyacrylamide in comparison to bentonite may be increased to decrease the WRV (independently or in conjunction with adjustments to the quantity or ratio of surfactant).

EXAMPLES

Water retention value (WRV) is a laboratory scale comparative measure of water content in a paper mat after the pressing portion. The test involves a 40 g sample of pulp centrifuged at 900 G for 30 minutes. After the 30 minutes, the sample is weighed. The sample is subsequently oven dried for a minimum of 12 hours, and reweighed. The WRV is calculated by the following equation:

$$WRV = \frac{\left(\begin{array}{c}\text{Weight of Pad after Centrifuging} - \\ \text{Weight of Oven Dried Pad}\end{array}\right)}{(\text{Weight of Oven Dried Pad})} \quad (2)$$

The water retention value test may be modified to model different water removal conditions for specific forming and pressing conditions. A reduction in the WRV translates into a decrease in the water load entering the dryer section.

Example 1

Figure 2:
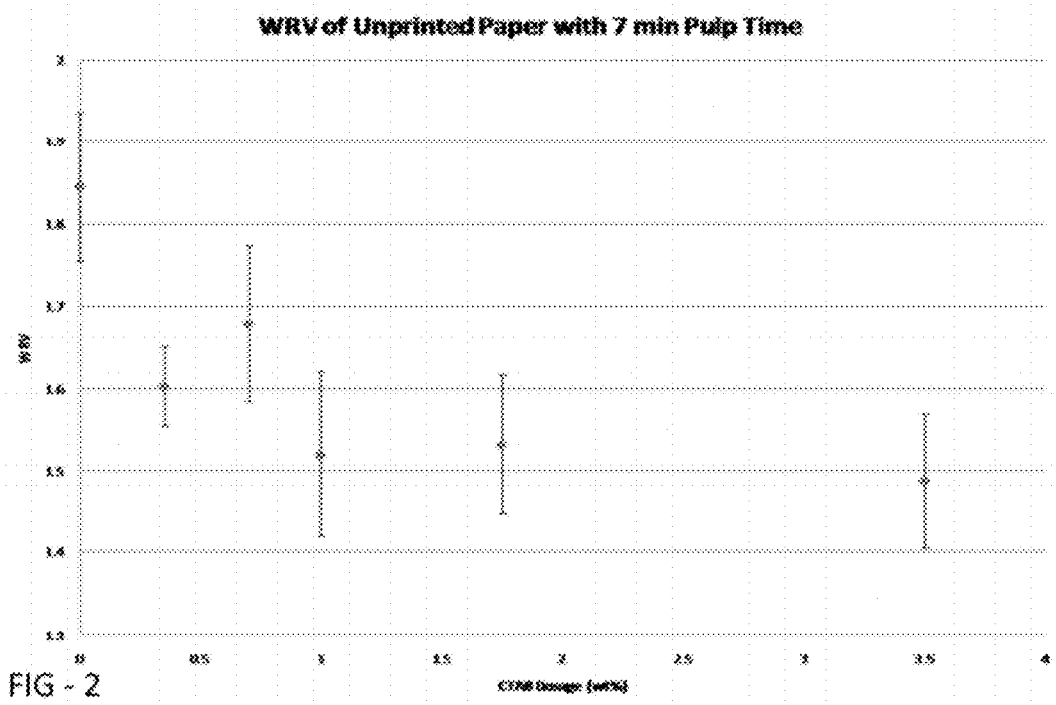
FIG. 2 shows a plot of the relationship between water retention value and quantity of a surfactant according to an exemplary embodiment of the disclosure for unprinted pulp.

In a first example, a sample was prepared by pulping 40 grams of unprinted fiber in one liter of tap water (at about 50 to about 60° C.) in a disintegrator to form a 4% (by wet weight) pulp slurry. The surfactant cetyl trimethylammonium bromide ($(C_{16}H_{33})N(CH_3)_3Br$) (or CTAB) was added at the commencement of the pulping process. WRV was analyzed in comparison to the amount of surfactant during a 7 minute pulp time employing unprinted recycled paper. The quantities of the surfactant tested were 0% (control), 0.35%, 0.70%, 1.0%, 1.75%, and 3.5% (by weight % of the fiber). In general, as shown in FIG. 2, as the amount of surfactant increased, the WRV decreased. At an amount of 1% surfactant, WRV decreased over 20%.

Example 2

Figure 3:
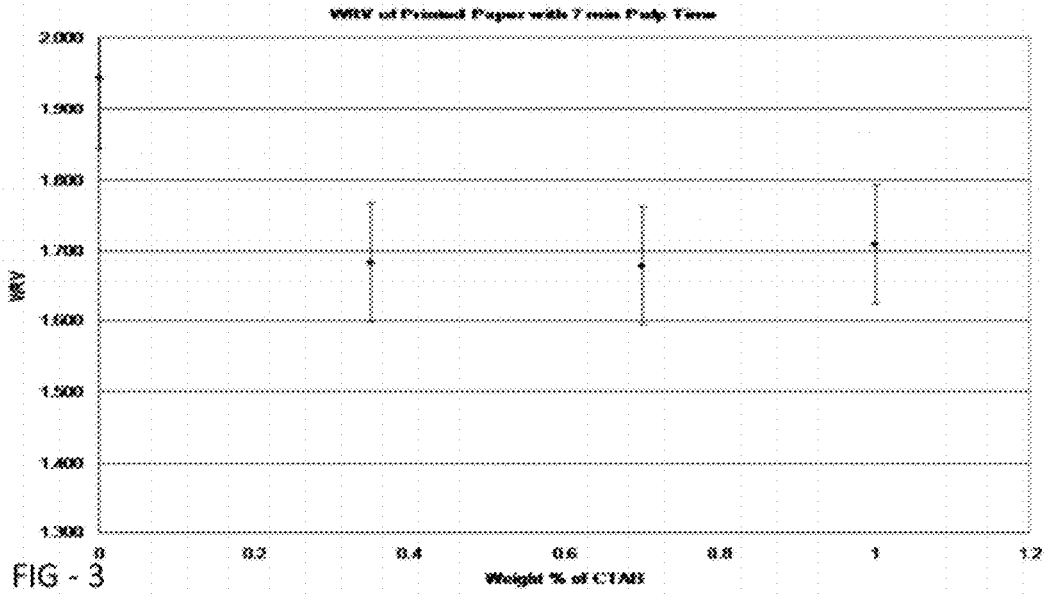
FIG. 3 shows a plot of the relationship between water retention value and quantity of a surfactant according to an exemplary embodiment of the disclosure for printed pulp.

In a second example, a sample was prepared by pulping 40 grams of printed fiber in one liter of tap water (at about 50 to about 60° C.) in a disintegrator to form a 4% pulp slurry (by wet weight). The surfactant CTAB was added at the commencement of the pulping process. WRV was analyzed in comparison to the amount of surfactant during a 7 minute pulp time employing printed recycled paper. The quantities of the surfactant tested were 0.0% (control), 0.35%, 0.70%, and 1.0% (by weight % of the fiber). As shown in FIG. 3, the WRV decreased. However, it is believed that the ionic components of printed paper (for example, ink) complexed with the cationic surfactant reducing the surfactant's effectiveness at lowering the WRV relative to that found in Example 1. Pulping time was varied from 7, 10, 15 to 30 minutes with no changes in the WRV noted.

Example 3

Figure 4:
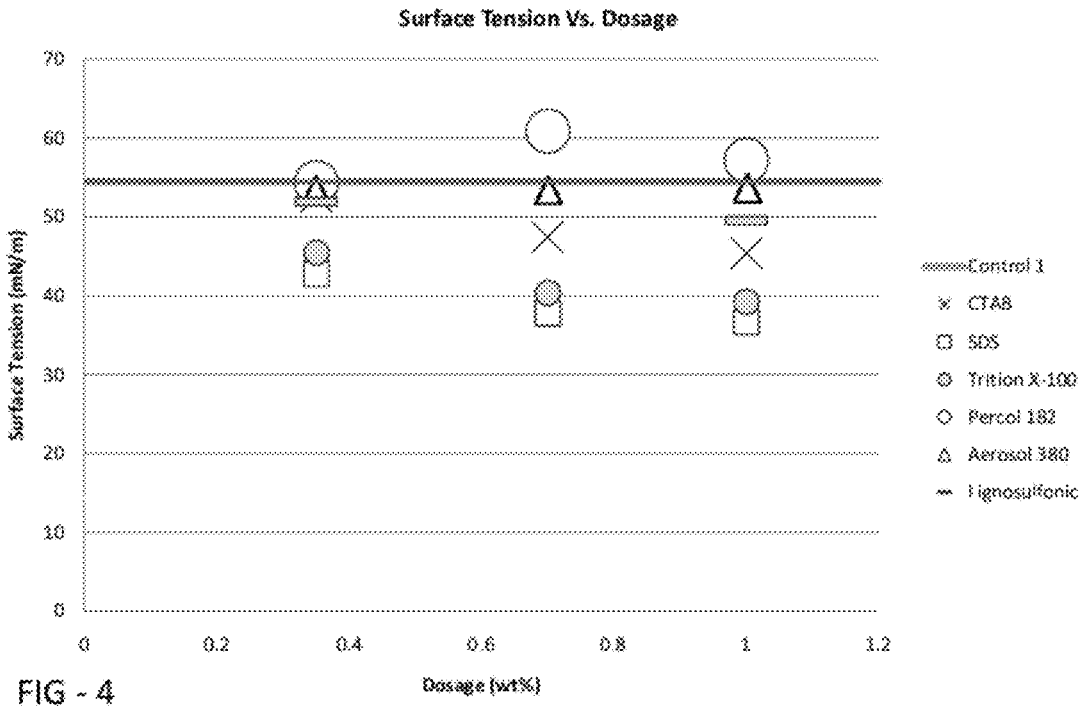
FIG. 4 shows a plot of the relationship between surface tension and quantity of several exemplary surfactants and comparative examples according to an exemplary embodiment of the disclosure.
Figure 5:
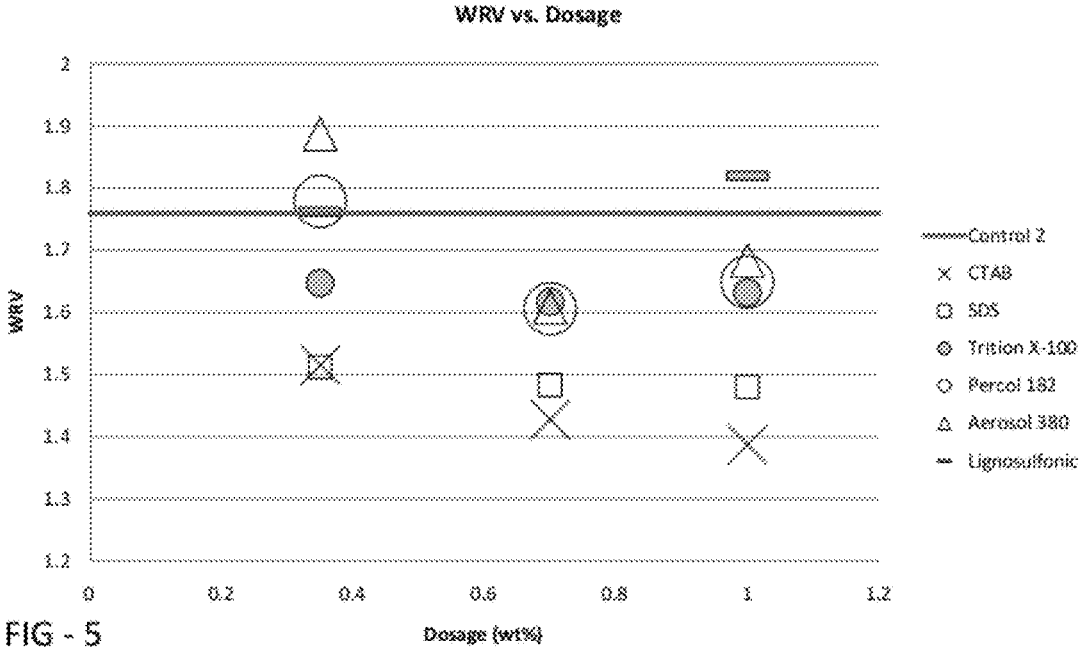
FIG. 5 shows a plot of the relationship between water retention value and quantity of several exemplary surfactants and comparative examples according to an exemplary embodiment of the disclosure.

In a third example, a sample was prepared by pulping 40 grams of fiber in one liter of tap water (at about 50 to about 60° C.) in a disintegrator to form a 4% pulp slurry (by wet weight). Sodium dodecyl sulfate (SDS) (an anionic surfactant) was added at the commencement of the pulping process. WRV was analyzed in comparison to the amount of surfactant during a 7 minute pulp time employing unprinted recycled paper. The quantities of the surfactant tested were 0.35%, 0.70%, and 1.0% (by weight % of the fiber). As shown in FIG. 4, surface tension was decreased in comparison to a control (Control 1). As shown in FIG. 5, WRV was decreased in comparison to a control (Control 2).

Example 4

In a fourth example, a sample was prepared by pulping 40 grams of fiber in one liter of tap water (at about 50 to about 60° C.) in a disintegrator to form a 4% pulp slurry (by wet weight). Lignosulfonic acid (an anionic surfactant) was added at the commencement of the pulping process. WRV was analyzed in comparison to the amount of surfactant during a 7 minute pulp time employing unprinted recycled paper. The quantities of the surfactant tested were 0.35% and 1.0% (by weight % of the fiber). As shown in FIG. 4, surface tension was decreased in comparison to a control (Control 1). As shown in FIG. 5, WRV was not decreased in comparison to a control (Control 2).

Example 5

In a fifth example, a sample was prepared by pulping 40 grams of fiber in one liter of tap water (at about 50 to about 60° C.) in a disintegrator to form a 4% pulp slurry (by wet weight). Trition X-100 (a non-ionic surfactant) was added at the commencement of the pulping process. WRV was analyzed in comparison to the amount of surfactant during a 7 minute pulp time employing unprinted recycled paper. The quantities of the surfactant tested were 0.35%, 0.70%, and 1.0% (by weight % of the fiber). As shown in FIG. 4, surface tension was decreased in comparison to a control (Control 1). As shown in FIG. 5, WRV was decreased in comparison to a control (Control 2).

Example 6

In a sixth example (a comparative example), a sample was prepared by pulping 40 grams of fiber in one liter of tap water (at about 50 to about 60° C.) in a disintegrator to form a 4% pulp slurry (by wet weight). Percol 182 (a cationic polymer) was added at the commencement of the pulping process. WRV was analyzed in comparison to the amount of the cationic polymer during a 7 minute pulp time employing unprinted recycled paper. The quantities of the cationic polymer tested were 0.35%, 0.70%, and 1.0% (by weight % of the fiber). As shown in FIG. 4, surface tension was not decreased in comparison to a control (Control 1). As shown in FIG. 5, WRV was decreased in comparison to a control (Control 2) for quantifies of 0.70% and 1.0%.

Example 7

In a seventh example, (another comparative example), a sample was prepared by pulping 40 grams of fiber in one liter of tap water (at about 50 to about 60° C.) in a disintegrator to form a 4% pulp slurry (by wet weight). Aerosol 380 (a colloidal silica) was added at the commencement of the pulping process. WRV was analyzed in comparison to the amount of the colloidal silica during a 7 minute pulp time employing unprinted recycled paper. The quantities of the silica tested were 0.35%, 0.70%, and 1.0% (by weight % of the fiber). As shown in FIG. 4, surface tension was barely decreased in comparison to a control (Control 1). As shown in FIG. 5, WRV was decreased in comparison to a control (Control 2) for quantities of 0.70% and 1.0%.

In sum, all four surfactants (SDS, Trition X-100, CTAB, and lignosulfonic acid) showed decreases in the surface tension in comparison to Control 1. The examples suggest that the degree of the decrease was a function of quantity. The variation of the quantities showed a decrease in quantity dependency between SDS, Trition X-100, CTAB, and lignosulfonic acid. CTAB, SDS, and Trition X-100 showed notable decreases in WRV. The degree of effectiveness as a function of quantity decreases from CTAB, to SDS, to Trition X-100.

Example 8

Figure 6:
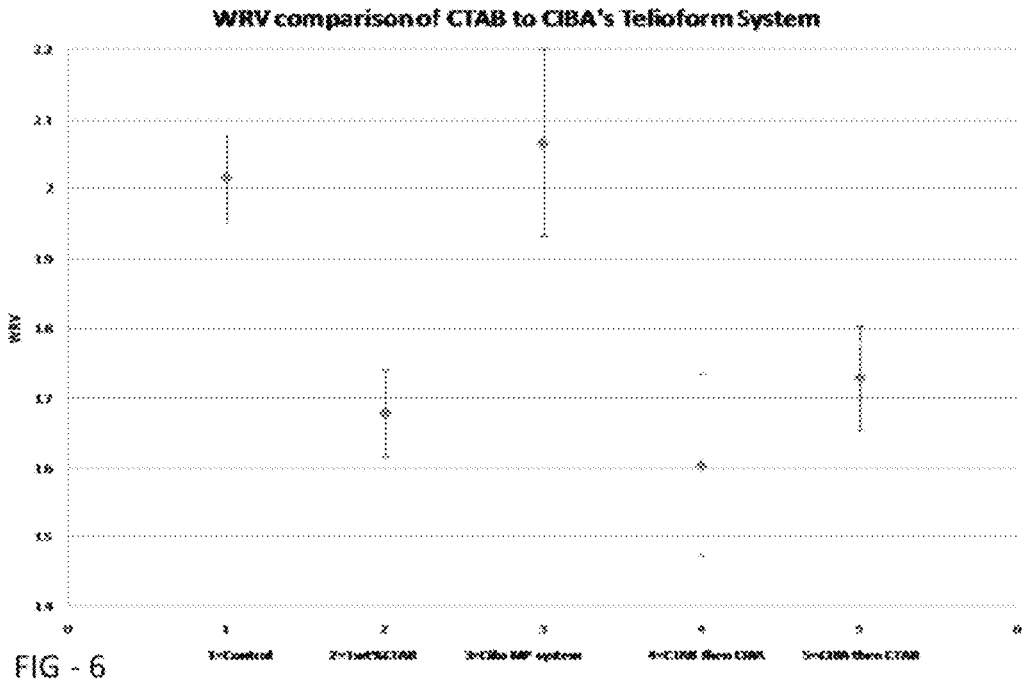
FIG. 6 shows a plot of the relationship between WRV and exemplary methods of using an exemplary surfactant in conjunction with a retention package according to an exemplary embodiment of the disclosure.
Figure 7:
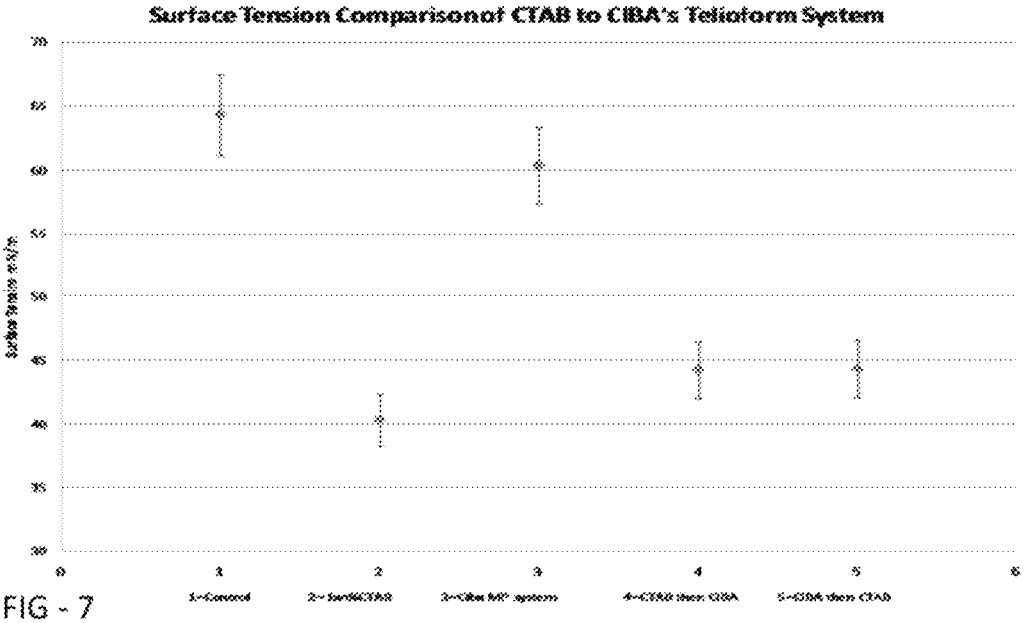
FIG. 7 shows a plot of the relationship between surface tension and exemplary methods of using an exemplary surfactant in conjunction with a retention package according to an exemplary embodiment of the disclosure.

In an eighth example, a sample was prepared by adding CTAB during pulping at about 1 wt % (2=1 wt % CTAB). As shown in FIGS. 6 and 7, WRV and surface tension of a control (1=Control) with recycled directory pulp were measured. The data (including error calculations) was used for comparison to embodiments of the present disclosure and for comparison to comparative examples as explained in Examples 9 through 11.

Example 9

In a ninth example, a sample was prepared by adding Ciba's Telioform retention system (now available through BASF) under a high shear mixing environment (3=Ciba MP system) and added it to the pulp slurry. Ciba's Telioform retention system includes Ciba Percol, Ciba Hydrocol, Ciba Alcofix, and Ciba Telioform. As shown in FIGS. 6 and 7, WRV and surface tension were measured. As shown in FIG. 6, WRV was substantially similar in comparison to the control (1=Control) but higher than the CTAB (2=1 wt % CTAB). As shown in FIG. 7, surface tension was substantially unchanged in comparison to the control (1=Control) but higher than the CTAB (2=1 wt % CTAB).

Example 10

In a tenth example, a sample was prepared by adding the Ciba Telioform retention system to a batch of pulp previously treated with 1 wt % CTAB (4=CTAB then CIBA). As shown in FIGS. 6 and 7, WRV and surface tension were measured. As shown in FIG. 6, WRV was decreased in comparison to the control (1=Control), substantially similar to the CTAB (2=1 wt % CTAB), and decreased in comparison to the Ciba Telioform retention System (3=Ciba MP system). As shown in FIG. 7, surface tension was decreased in comparison to the control (1=Control), slightly higher than the CTAB (2=1 wt % CTAB), and decreased in comparison to the Ciba Telioform System (3=Ciba MP system).

Example 11

In an eleventh example, a sample was prepared by adding 1 wt % CTAB to a pulp already prepared with the Ciba Telioform retention system (5=CIBA then CTAB). As shown in FIGS. 6 and 7, WRV and surface tension were measured. As shown in FIG. 6, WRV was decreased in comparison to the control (1=Control), substantially similar to the CTAB (2=1 wt % CTAB), decreased in comparison to the Ciba Telioform retention system (3=Ciba MP system), and slightly above the Ciba Telioform system with 1 wt % CTAB added (4=CTAB then CIBA). As shown in FIG. 7, surface tension was decreased in comparison to the control (1=Control), slightly higher than the CTAB (2=1 wt % CTAB), decreased in comparison to the Ciba Telioform retention system (3=Ciba MP system), and substantially the same as the Ciba Telioform retention system with 1 wt % CTAB added (4=CTAB then CIBA).

Example 12

In a twelfth example, a pulp was prepared to make paper. The pulp was stored in mixing tanks overnight. A fourdrinier paper machine was used for making the paper. Then, CTAB was added at about 1.0%. The CTAB was introduced directly to the pulp in the mixing tank rather than during the pulping process. Product specifications were a 74 g/m$^2$ basis weight with about 5% sheet moisture upon input. The trial was run for one day, individual conditions were run at steady state for about 45 minutes. Steam pressure, pressing force, and forming section vacuum settings were kept constant. Furnish freeness was verified at the beginning of each run. Head box samples were taken every 20 minutes to collect data on pH and also to perform a Mutek charge potential. Product samples were gathered after a couch, a second press, and at a machine reel to determine water content at each portion of the process. A portion of the sample was dried on a hot plate for an immediate sheet solids number to provide a guide, and three additional samples were placed in a 105° C. oven over night for final sheet solids. Paper was also collected from the reel to provide samples for sheet surface tension and other sheet property testing. A 2.5% solids increase after the forming portion was noted. A 1.25% solids increase after the pressing portion was noted. A 2% increase in reel solids was noted.

Example 13

Figure 8:
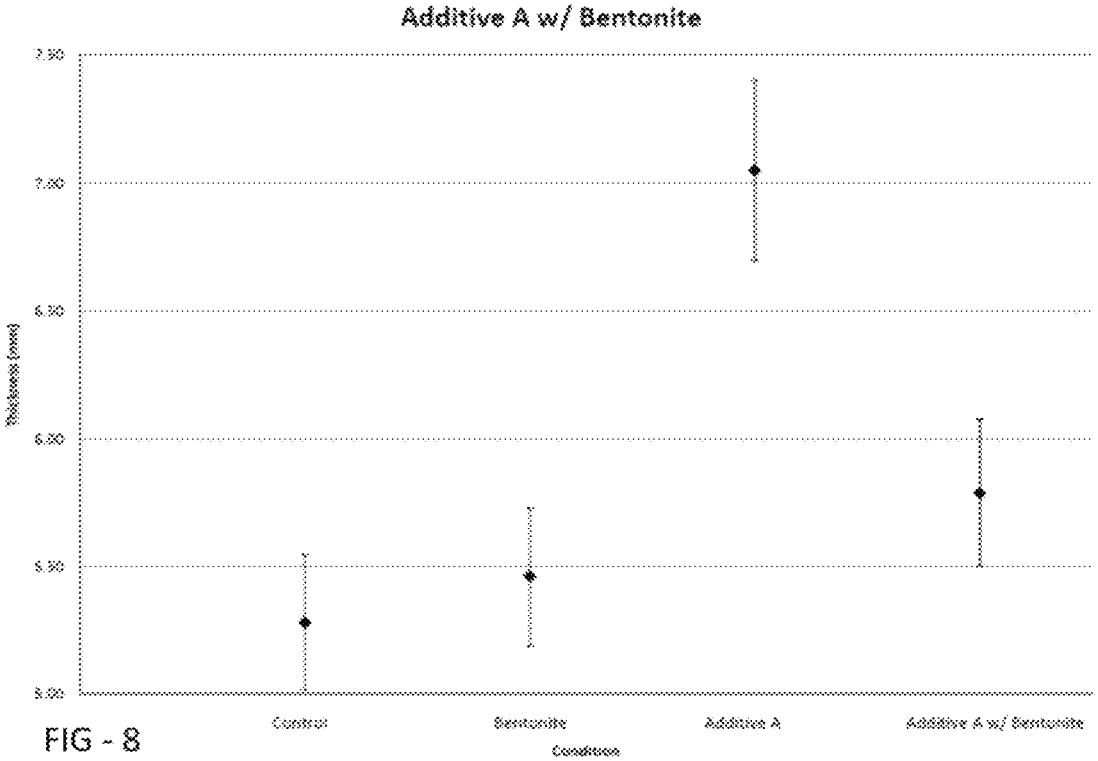
FIG. 8 shows a comparative plot of thickness of cellulosic products formed according to exemplary methods of the disclosure.
Figure 9:
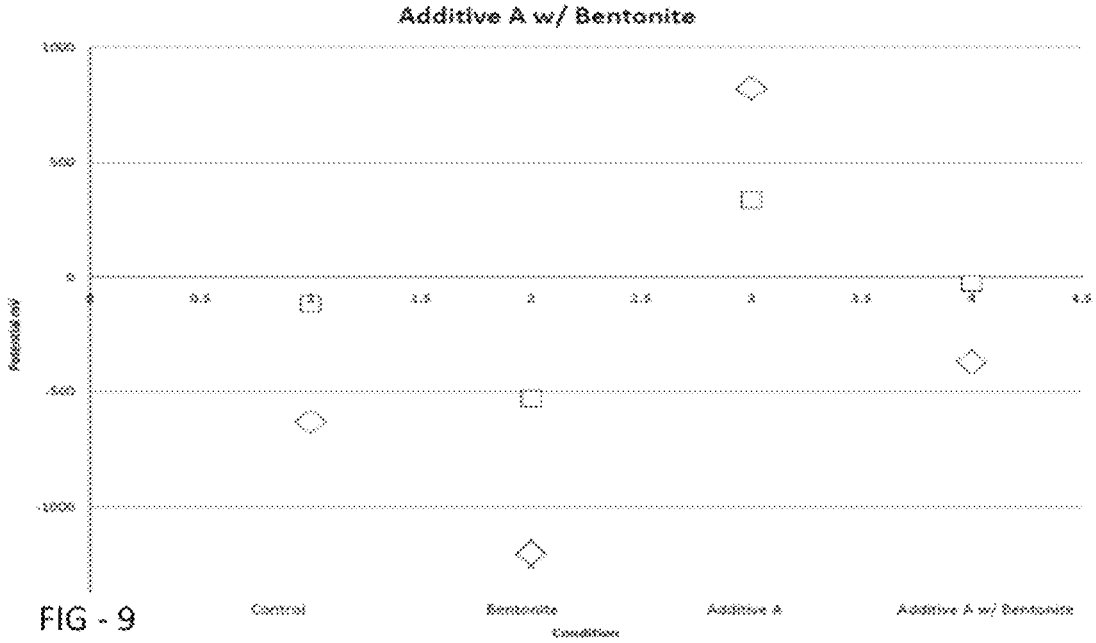
FIG. 9 shows a comparative plot of charges and potential of cellulosic products formed according to exemplary methods of the disclosure.
Figure 10:
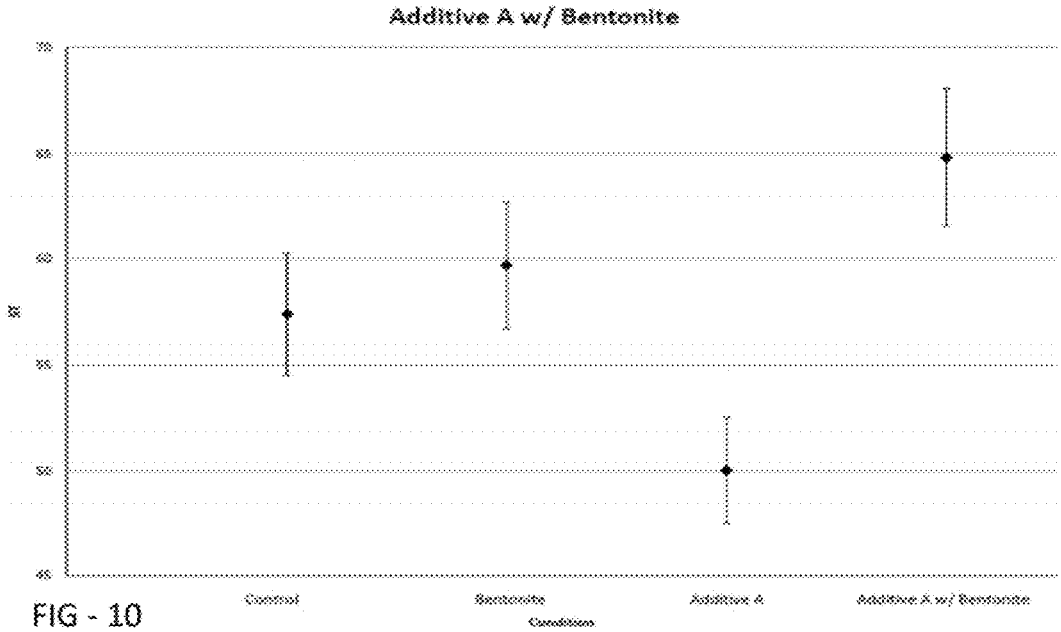
FIG. 10 shows a comparative plot of surface tension of cellulosic products formed according to exemplary methods of the disclosure.
Figure 11:
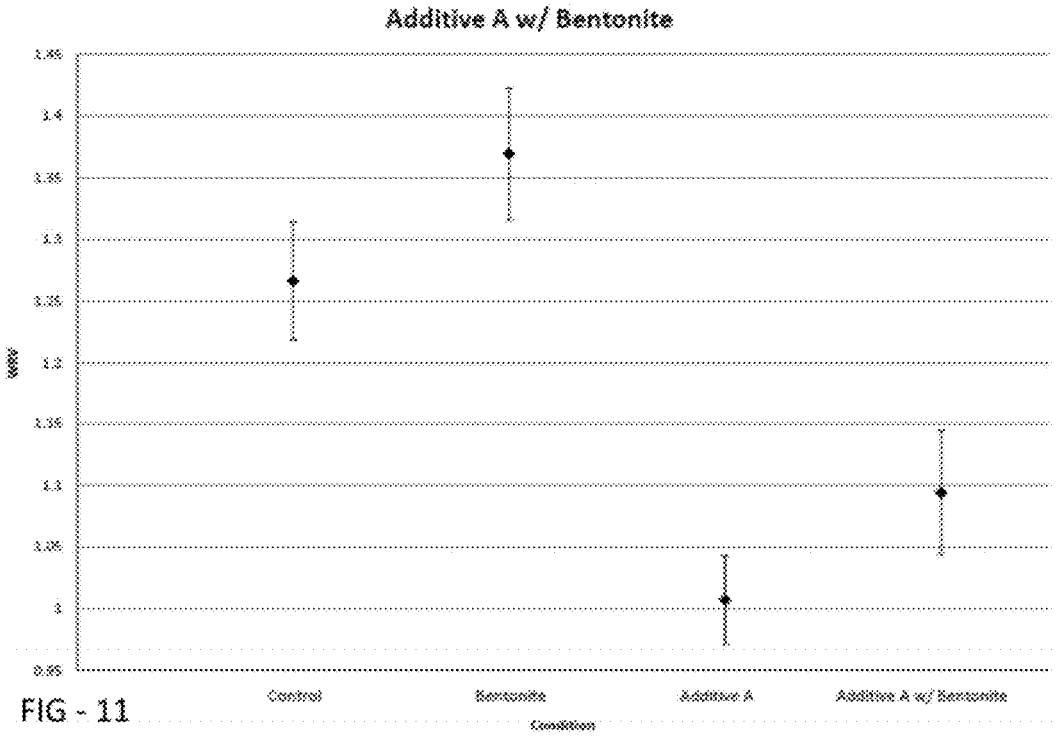
FIG. 11 shows a comparative plot of water retention value of cellulosic products formed according to exemplary methods of the disclosure.

In a thirteenth example, four samples were prepared. A first sample included the pulp slurry (Control). A second sample included the pulp slurry and bentonite. A third sample included the pulp slurry and the surfactant (Additive A), specifically CTAB. A fourth sample included the pulp slurry, the bentonite, and the surfactant (Additive A w/Bentonite). Bulk, charge and potential, surface tension, and WRV for each sample were measured. As shown in FIG. 8, the bentonite resulted in a marginally greater thickness cellulosic product than the control and the surfactant resulted in an even higher thickness cellulosic product. Adding the bentonite to the pulp slurry and the surfactant resulted in a lower thickness cellulosic product in comparison to the pulp slurry with the surfactant. As shown in FIG. 9 (showing a data series for charge with squares and a data series for potential with diamonds), the bentonite resulted in a lower charge and potential cellulosic product than the control and the surfactant resulted in a higher charge and potential cellulosic product. Adding the bentonite to the pulp slurry and the surfactant resulted in a cellulosic product having a charge and potenital lower than the cellulosic product formed with the surfactant but higher than the cellulosic product formed with the bentonite. As shown in FIG. 10, the bentonite resulted in a marginally greater surface tension cellulosic product than the control and the surfactant resulted in a lower surface tension cellulosic product. Adding the bentonite to the pulp slurry and the surfactant resulted in a cellulosic product having an even greater surface tension than the cellulosic product formed with just the bentonite. As shown in FIG. 11, the bentonite resulted in a cellulosic product having a greater WRV than the control and the surfactant resulted in a cellulosic product having a lower WRV than the control. Adding the bentonite to the pulp slurry and the surfactant resulted in a cellulosic product having a WRV marginally greater than the cellulosic product formed with the surfactant but lower than the control.

Example 14

Figure 12:
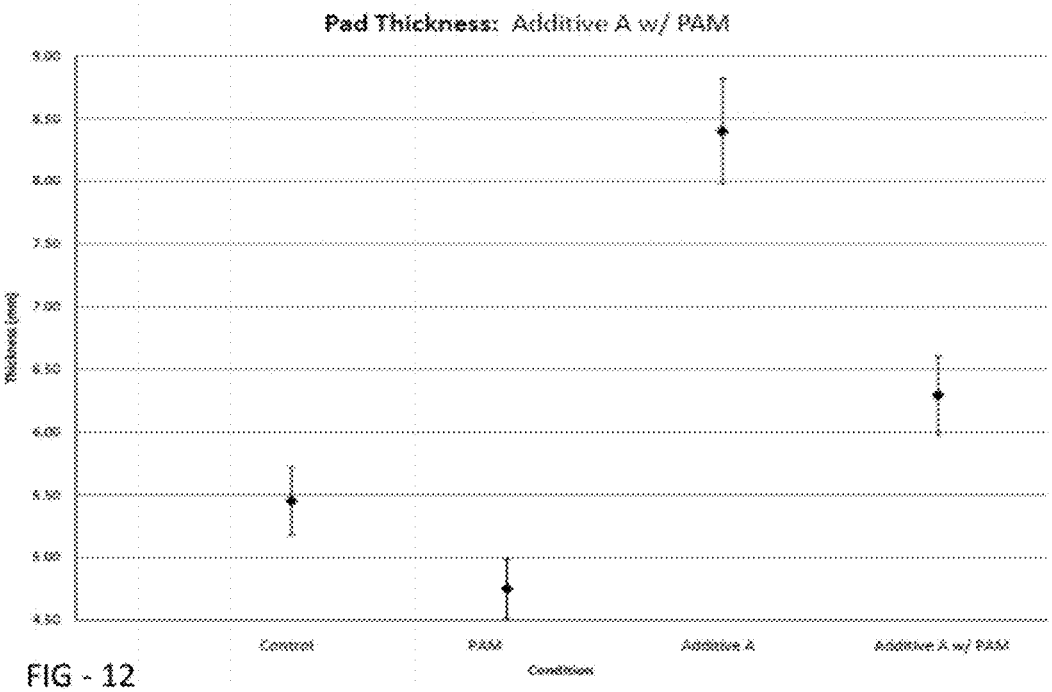
FIG. 12 shows a comparative plot of thickness of cellulosic products formed according to exemplary methods of the disclosure.
Figure 13:
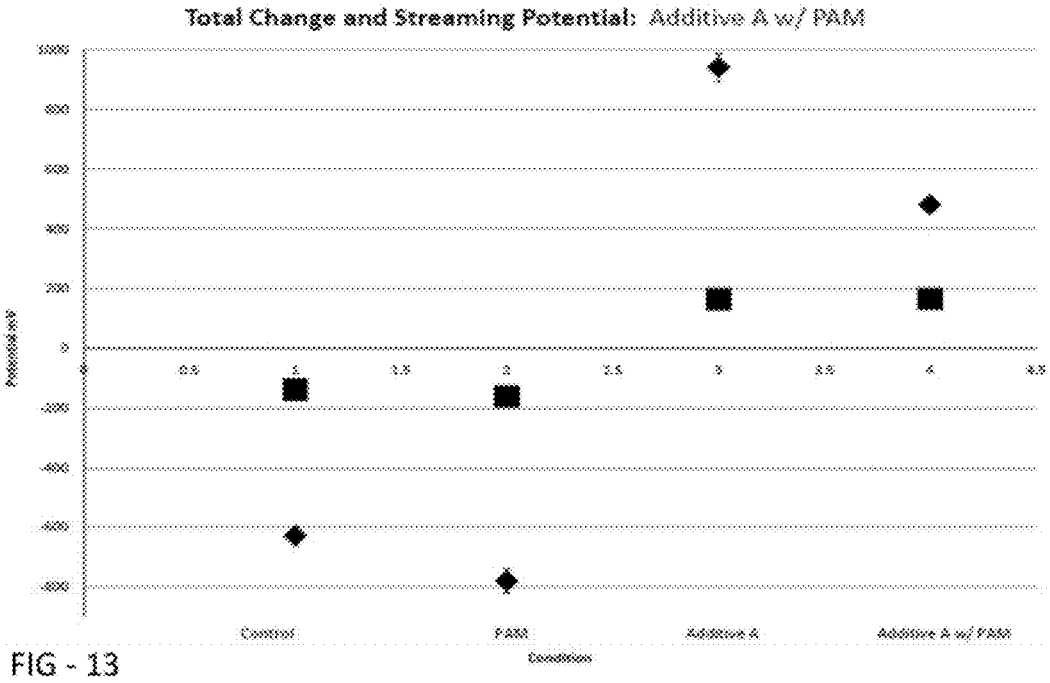
FIG. 13 shows a comparative plot of charges and potential of cellulosic products formed according to exemplary methods of the disclosure.
Figure 14:
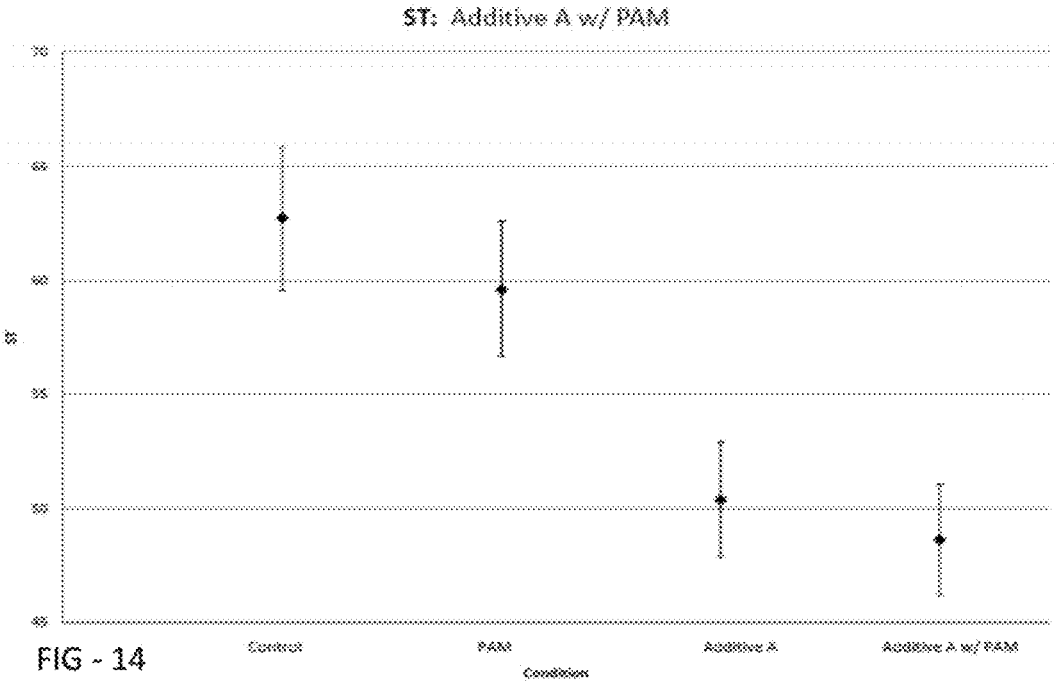
FIG. 14 shows a comparative plot of surface tension of cellulosic products formed according to exemplary methods of the disclosure.
Figure 15:
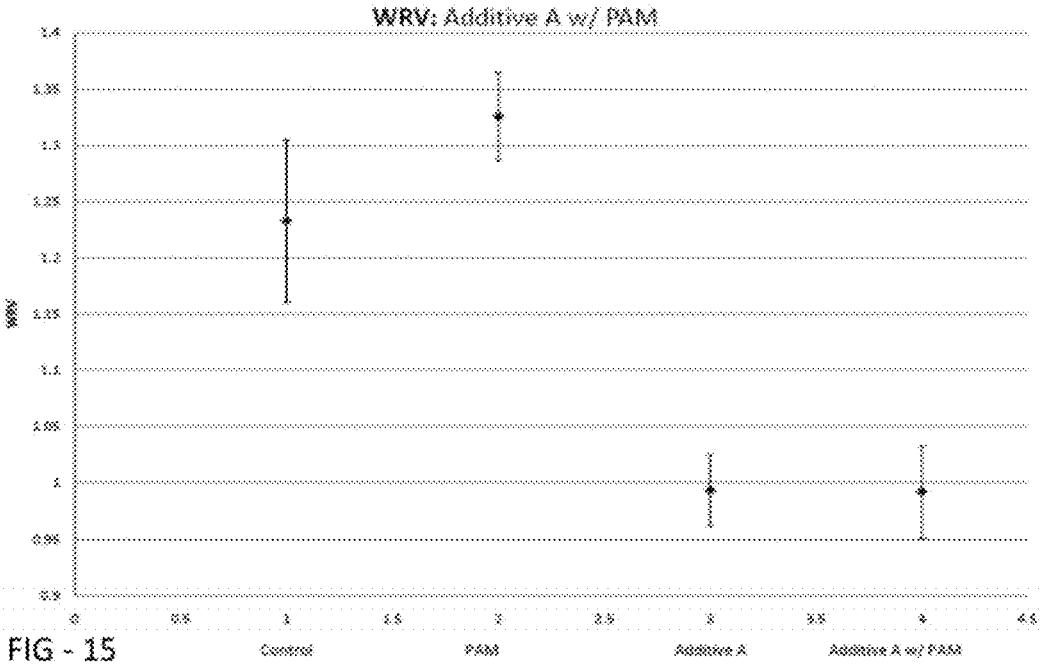
FIG. 15 shows a comparative plot of water retention value of cellulosic products formed according to exemplary methods of the disclosure.

In a fourteenth example, four samples were prepared. A first sample included the pulp slurry (Control). A second sample included the pulp slurry and anionic polyacrylamide (PAM). A third sample included the pulp slurry and the surfactant (Additive A), specifically CTAB. A fourth sample included the pulp slurry, the polyacrylamide, and the surfactant (Additive A w/PAM). Bulk, charge, surface tension, and WRV for each sample were measured. As shown in FIG. 12, the polyacrylamide resulted in a lower thickness cellulosic product than the control and the surfactant resulted in a higher thickness cellulosic product. Adding the polyacrylamide to the pulp slurry and the surfactant resulted in a lower thickness cellulosic product than the cellulosic product formed with the surfactant but a greater thickness than the control. As shown in FIG. 13 (showing a data series for charge with squares and a data series for potential with diamonds), the polyacrylamide resulted in a lower potential and marginally lower charge cellulosic product than the control and the surfactant resulted in a higher charge and potential cellulosic product. Adding the polyacrylamide to the pulp slurry and the surfactant resulted in a cellulosic product having a drop in potential and substantially no change in charge in comparison to the cellulosic product formed with the pulp slurry and the surfactant. As shown in FIG. 14, the polyacrylamide resulted in a marginally lower surface tension cellulosic product than the control and the surfactant resulted in an even lower surface tension cellulosic product. Adding the polyacrylamide to the pulp slurry and the surfactant resulted in a cellulosic product having an even lower surface tension than the cellulosic product formed with just the surfactant. As shown in FIG. 15, the polyacrylamide resulted in a cellulosic product having a greater WRV than the control and the surfactant resulted in a cellulosic product having a lower WRV than the control.

Adding the polyacrylamide to the pulp slurry and the surfactant did not notably affect the WRV in comparison to the cellulosic product formed with the pulp slurry and the surfactant.

Example 15

Figure 16:
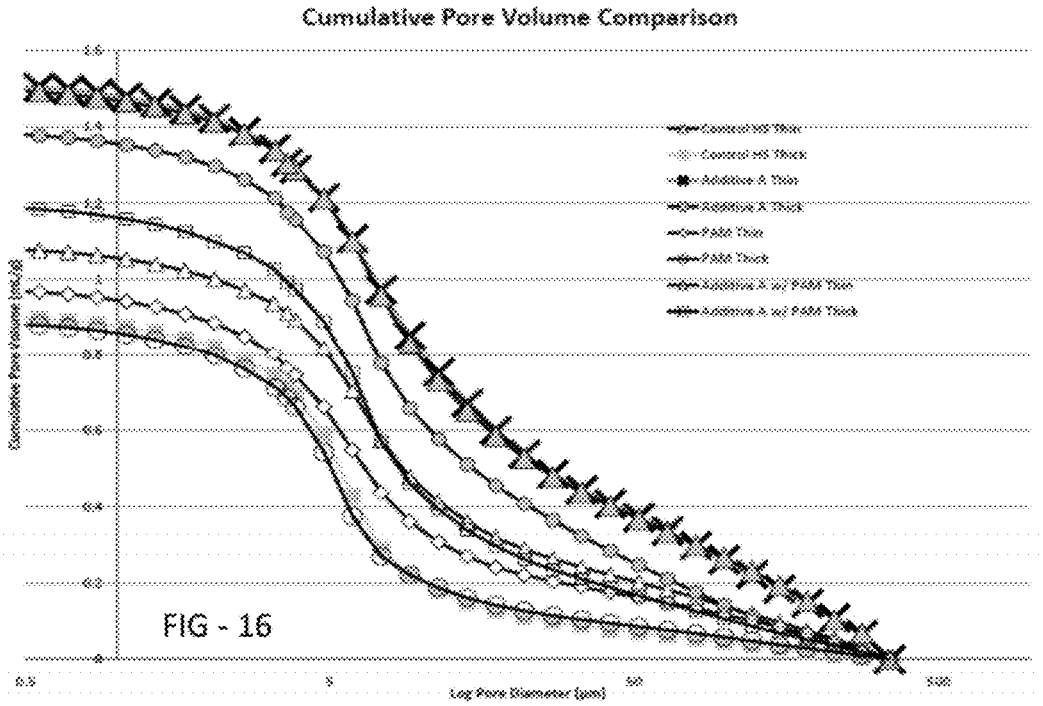
FIG. 16 shows a comparative plot of cumulative pore volume of cellulosic products formed according to exemplary methods of the disclosure.
Figure 17:
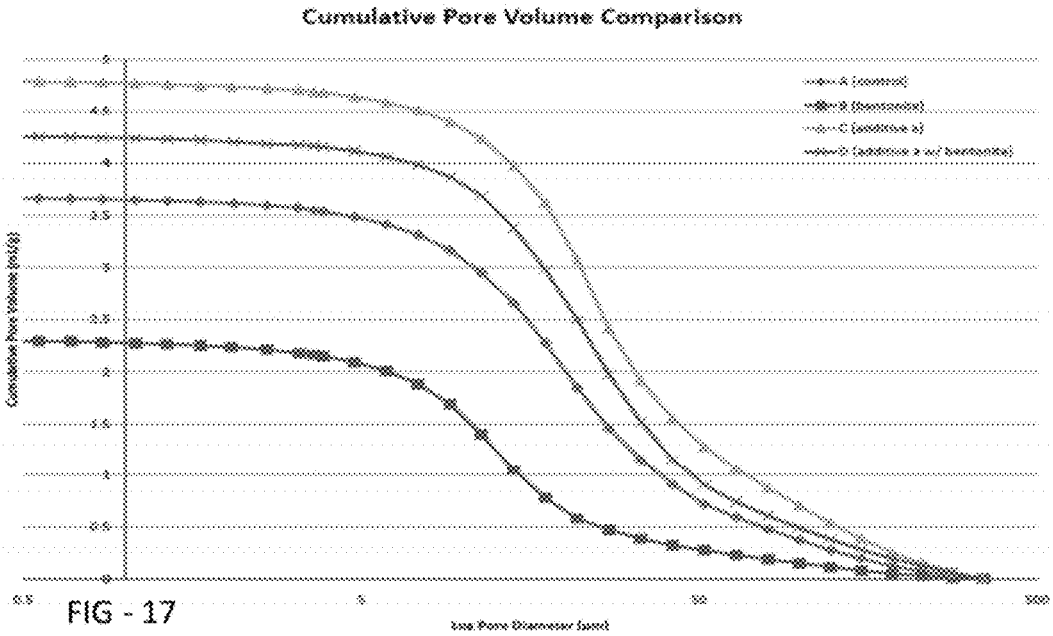
FIG. 17 shows a comparative plot of cumulative pore volume of cellulosic products formed according to exemplary methods of the disclosure.

In a fifteenth example, eight samples were produced. A first sample was a thin cellulosic product (Control HS Thin). A second sample was a thick cellulosic product (Control HS Thick). The thin cellulosic product was about 25 thousandths of an inch or about half the thickness of the thick cellulosic product. A third sample was a thin cellulosic product formed with the surfactant (Additive A Thin). A fourth sample was a thick cellulosic product formed with the surfactant (Additive A Thick). A fifth sample was a thin cellulosic product formed with the polyacrylamide (PAM Thin). A sixth sample was a thick cellulosic product formed with the polyacrylamide (PAM Thick). A seventh sample was a thin cellulosic product formed with the surfactant and the polyacrylamide (Additive A w/PAM Thin). An eighth sample was a thick cellulosic product formed with the surfactant and the polyacrylamide (Additive A w/PAM Thick). As shown in FIG. 16, the surfactant increases cumulative pore volume. For thick substrates, combining the polyacrylamide to the surfactant and the pulp slurry reduces the magnitude of an increase in cumulative pore volume seen with the surfactant only.

Example 16

In an sixteenth example, four samples were produced. A first sample was a cellulosic product (control). A second sample was a cellulosic product formed with the additive (bentonite). A third sample was a cellulosic product formed with the surfactant (additive a), specifically CTAB. A fourth sample was a cellulosic product formed with the surfactant and the additive (additive A w/bentonite). Combining the bentonite to the surfactant and the pulp slurry reduces the magnitude of an increase in cumulative pore volume seen with the surfactant only.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For example, ranges, relationships, quantities, and comparisons between aspects of the disclosure (including the Examples and the Figures) are included within the scope of the invention. Therefore, it is intended that the invention not be limited to the particular embodiment disclosed as the best mode contemplated for carrying out this invention, but that the invention will include all embodiments falling within the scope of the appended claims.

The invention claimed is:

1. A wet formed cellulosic product, the product comprising;

a cationic surfactant and an additive, wherein the cationic surfactant is cetyl trimethylammonium bromide ($(C_{16}H_{33})N(CH_3)_3Br$) or the additive is bentonite, wherein the additive includes one or more of the bentonite; polyacrylamide; montmorrilnites; phylosilicates, anionic additives; polyacrylic acid; polystyrene sulfonate; polymers having an acid selected from the group consisting of sulfonic acid, phosphoric acid, salts of carboxylic acid, salts of phosphoric acid, salts of sulfonic acid, and salts of phosphoric acid; natural polymers; modified natural polymers; synthetic polymers; homopolymers of polyacrylates; homopolymers of polysulfonates; homopolymers of polyphosphates; copolymers of polyacrylates; copolymers of polysulfonates; copolymers of polyphosphates; polyacrylic acid; polymethacrylic acid; polystyrenesulfonic acid; carboxymethylcellulose; guar and xanthan gums; anionic starch; amphoteric starch; copolymers of acrylic acid and acrylamide; silica; calcium carbonate; titanium dioxide; and alumina.

2. The product of claim 1, wherein the cationic surfactant is cetyl trimethylammonium bromide ($(C_{16}H_{33})N(CH_3)_3Br$).

3. The product of claim 1, wherein the wet formed cellulosic product is selected from the group consisting of paper and ceiling board.

4. The product of claim 1, wherein the additive is bentonite.

5. The product of claim 1, wherein the additive is polyacrylamide.

* * * * *